US009199310B2

(12) United States Patent
Al-Sudani et al.

(10) Patent No.: US 9,199,310 B2
(45) Date of Patent: Dec. 1, 2015

(54) NANO-GRAINED NICKEL TITANIUM ALLOY FOR IMPROVED INSTRUMENTS

(75) Inventors: Dina Ibrahim Al-Sudani, Riyadh (SA); Nasser Al-Aqeeli, Riyadh (SA); Gianluca Gambarini, Rome (IT)

(73) Assignee: King Saud University, Riyadh (SA)

( * ) Notice: Subject to any disclaimer, the term of this patent is extended or adjusted under 35 U.S.C. 154(b) by 1163 days.

(21) Appl. No.: 13/156,338

(22) Filed: Jun. 9, 2011

(65) Prior Publication Data

US 2012/0315178 A1 Dec. 13, 2012

(51) Int. Cl.

| | |
|---|---|
| ***B22F 3/12*** | (2006.01) |
| ***B22F 5/12*** | (2006.01) |
| ***C22C 1/04*** | (2006.01) |

(52) U.S. Cl.

CPC ..... *B22F 5/12* (2013.01); *C22C 1/0433* (2013.01); *B22F 2998/10* (2013.01)

(58) Field of Classification Search

CPC ..... B22F 3/12
USPC ..... 419/30
See application file for complete search history.

(56) References Cited

U.S. PATENT DOCUMENTS

2010/0107628 A1* 5/2010 Schaffer ..... 60/527

OTHER PUBLICATIONS

Ye et al., Consolidation of MA amorphous NiTi powders by spark plasma sintering, Materials Science and Engineering: A, vol. 241, Issues 1-2, Jan. 1998, pp. 290-293.*

J. Butler, et al Production of Nitinol Wire from Elemental Nickel and Titanium Powders Through Spark Plasma Sintering and Extrusion, Journal of Materials Engineering and Performance, 758—vol. 20(4-5) Jul. 2011.*

* cited by examiner

*Primary Examiner* — Jessee Roe
*Assistant Examiner* — Christopher Kessler
(74) *Attorney, Agent, or Firm* — Hauptman Ham, LLP

(57) ABSTRACT

The systems and methods of this patent application are directed to producing a composition of nano-grained NiTi (Ni—nickel, Ti—titanium) alloy for use in producing nano-grained wires. Nano-grained wires, for example, are used to generate medical instruments such as an endodontic instrument. A specific method of producing the nano-grained composition includes preparing a mixture of nickel (Ni) powder and titanium (Ti) powder. The mixture of nickel powder and titanium powder is sintered to produce a nano-grained NiTi alloy. In one embodiment, an endodontic instrument is formed using the nano-grained NiTi alloy and heat-treated.

3 Claims, 2 Drawing Sheets

NANO-GRAINED NICKEL TITANIUM ALLOY FOR IMPROVED INSTRUMENTS

BACKGROUND

Dentists and other medical workers, when performing certain treatments on a patient's tooth, use endodontic instruments such as endodontic files. These treatments include root canal treatments and other treatments involving the tooth pulp or the root of the tooth. Endodontic instruments may be coupled to a device that rotates the instrument to assist with shaping and/or cleaning the portion of the tooth being treated. These instruments can be manufactured in different sizes with varying amounts of taper applied to the instrument. In typical instruments, lengths range from 20-35 mm (millimeters) and instrument taper ranges from 2% to 12%.

Endodontic instruments are typically manufactured using metal, such as stainless steel or a metal alloy. One type of metal alloy used in manufacturing endodontic instruments is a nickel-titanium (NiTi) alloy. In general, nickel-titanium endodontic instruments provide greater flexibility and are more resistant to cyclic fatigue than stainless steel instruments. However, nickel-titanium endodontic instruments operated in a rotational manner suffer from at least two types of fractures: fracture caused by torsion and fracture caused by flexural fatigue. A torsion fracture occurs when an instrument tip or another part of the instrument is locked in a tooth canal while the shank of the instrument continues to rotate.

Fracture caused by flexural fatigue occurs when the endodontic instrument rotates freely in a curved orientation, which generates tension/compression cycles at the point of maximum flex. For example, as the instrument is held in a static position and continues to rotate, the portion of the instrument shaft on the outside of the curve is in tension while the portion of the instrument shaft on the inside of the curve is in compression. This repeated tension-compression cycle caused by rotation within curved tooth canals increases cyclic fatigue over time and contributes to instrument fracture.

Additional factors that contribute to a failure of endodontic instruments produced using nickel-titanium include the machining and grinding procedures applied during the manufacturing process. These procedures may result in work-hardened areas of the instrument that are brittle. Traditional machining procedures may also result in cracks and tool marks that initiate fractures or otherwise contribute to the failure of the endodontic instrument. In particular, cracks, tool marks and other surface irregularities may induce failure due to the concentration of stress at those irregularities.

SUMMARY

The systems and methods of this patent application are directed to producing a composition of nano-grained NiTi (Ni—nickel, Ti—titanium) alloy for use in producing a nano-grained alloy. Nano-grained alloys can be formed into wires, which for example, are used to generate medical instruments such as an endodontic instrument. A specific method of producing the nano-grained composition includes preparing a mixture of nickel (Ni) powder and titanium (Ti) powder. The mixture of nickel powder and titanium powder is sintered to produce a nano-grained NiTi alloy. In one embodiment, an improved fatigue resistant endodontic instrument is formed using nano-grained NiTi alloy wires and heat-treated.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In the Figures, the left-most digit of a component reference number identifies the particular Figure in which the component first appears.

DETAILED DESCRIPTION

Overview

The systems and methods described herein relate to the creation of a nano-grained NiTi alloy composition that is used to generate fatigue resistant instruments such as, for example, improved endodontic instruments. These systems and methods produce instruments that have improved resistance to cyclic fatigue and torsional fatigue as compared to medical instruments manufactured using traditional machining and grinding procedures. The described methods for producing endodontic instruments form the instrument using a nano-grained NiTi material and heat treat the resulting instrument to provide resistance to fatigue. Heating and mechanically compacting a mixture of nickel powder and titanium powder produce the nano-grained NiTi material.

Although particular endodontic instruments discussed herein may refer to endodontic files, the methods for producing endodontic instruments are applicable to any type of instrument, such as files, reamers, broaches, and the like. In other embodiments, similar materials and procedures are used to produce wires and other pieces used in orthodontics to improve the desired movement of teeth.

An Exemplary Endodontic Instrument

Figure 1:
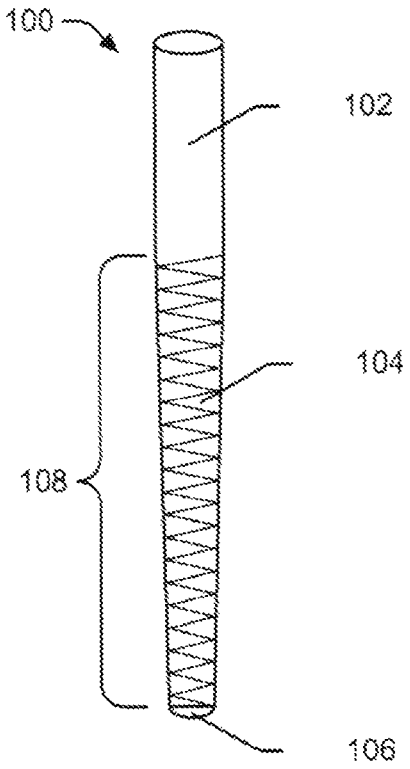
FIG. 1 shows an example endodontic instrument, according to one embodiment.

FIG. 1 shows an example endodontic instrument 100, according to one embodiment. In a particular implementation, endodontic instrument 100 is an endodontic file used to clean and shape root canals during endodontic procedures. Endodontic instrument 100 (also referred to as an "instrument body") includes a shank 102, a working portion 104, and a rounded tip 106. Working portion 104 includes various shapes, cutting edges, and/or textures that are appropriate for a particular dental or medical procedure. For example, working portion 104 can remove particles and portions of the interior of a tooth, depending on the endodontic procedure being performed.

Rounded tip 106 is provided as a safety feature to protect the patient as well as the operator of endodontic instrument 100, rather than using a sharp tip. As shown in FIG. 1, a portion 108 of endodontic instrument 100 is tapered such that the diameter of the instrument body decreases toward the tip 106 of the instrument. Endodontic instrument 100 has a length in the range of approximately 20-35 mm and the amount of taper ranges from approximately 2% to 12%, although the description contemplates other lengths and taper ranges.

In a particular embodiment, endodontic instrument 100 has a substantially cylindrical cross-sectional shape. In alternate embodiments, endodontic instrument 100 has any number of different shapes, such as a substantially triangular cross-sectional shape, a substantially square cross-sectional shape, or a spiral shape. One embodiment of endodontic instrument 100 is designed for coupling to a device, such as a handheld device, that rotates the instrument. In this embodiment, shank 102 of endodontic instrument 100 is mounted in a device that rotates the instrument. The rotational movement of endodontic instrument 100 enhances, for example, the cleaning and shaping of a root canal during an endodontic procedure. In another embodiment, endodontic instrument 100 includes a handle (not shown) attached to shank 102 that allows an operator to manually manipulate the instrument.

As discussed herein, endodontic instrument 100 is manufactured using a nano-grained NiTi material. The use of nano-grained NiTi material provides enhanced structural stability in the endodontic instrument. In particular, the nano-grained NiTi material typically experiences reduced dislocation activity due to the high density of the nano-structure. This high-density nano-structure reduces the likelihood that a dislocation activity will overcome the grain boundaries, thereby reducing the possibility of fracture and failure in the endodontic instrument.

Figure 2:
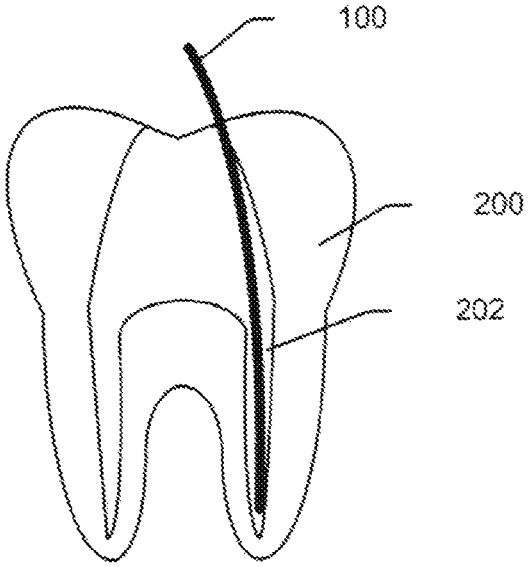
FIG. 2 shows an example operation of an endodontic instrument, according to one embodiment.

FIG. 2 shows an example operation of endodontic instrument 100, according to one embodiment. In this example, endodontic instrument 100 is inserted into a root canal 202 of a tooth 200 for the purpose of cleaning and/or shaping the root canal during an endodontic procedure. In other situations, endodontic instrument 100 performs a variety of other functions during endodontic procedures.

Exemplary Procedure for Producing Nano-Grained NiTi Alloy

As discussed above, nickel-titanium endodontic instruments provide greater flexibility and are more resistant to cyclic fatigue than stainless steel instruments. However, existing nickel-titanium endodontic instruments operated in a rotational manner suffer from at least two types of fractures: fracture caused by torsion and fracture caused by flexural fatigue. The procedures for producing endodontic instruments discussed herein utilize a nano-grained NiTi material and apply a heat treating process to the resulting instrument to provide resistance to these types of fractures.

Figure 3:
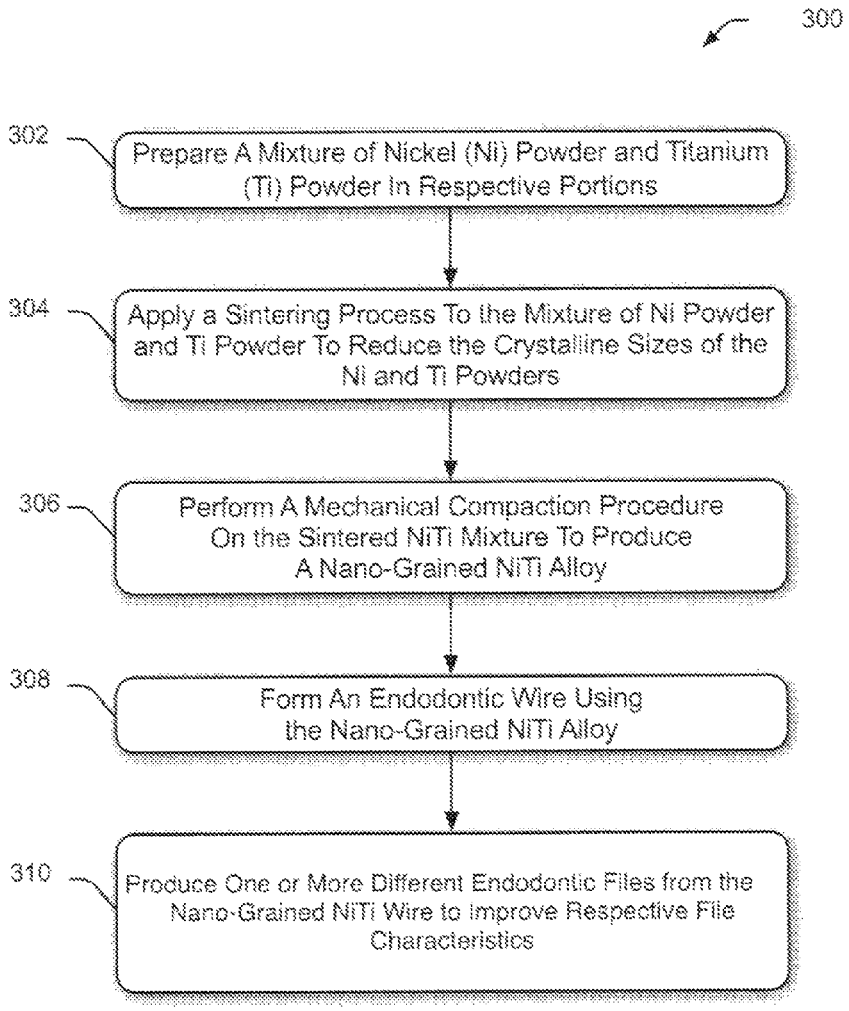
FIG. 3 shows an example procedure for producing the nano-grained NiTi alloy to produce improved fatigue resistant instrument(s), according to one embodiment.

FIG. 3 shows an example procedure 300 for producing instruments, for example, such as endodontic instruments, according to one embodiment. A mixture of nickel (Ni) powder and titanium (Ti) powder is initially prepared in a near-equiatomic composition (block 302). In a particular embodiment, the mixture is an equiatomic composition of nickel and titanium (e.g., containing 55% by weight Ni and 45% by weight Ti). In this particular embodiment, the following variation from the equiatomic composition is permitted to achieve the desired results: Ni (54-57% wt) and Ti (43.8 to 47.9% wt). The initial average particle size of the nickel particles and the titanium particles is approximately 30-40 μm (micrometers).

Procedure 300 continues as the NiTi blended powder is compacted and sintered in a vacuum tube furnace to reduce the crystalline sizes of the nickel and titanium powders (block 304). Sintering is a process of heating powder particles to a temperature below their melting point such that the particles adhere to one another and become a coherent mass. The reduction in crystalline sizes of the nickel and titanium particles during the sintering process reduces the large particle dimensions and low packing density typically found in unprocessed NiTi. In a particular implementation, the NiTi blended powder is sintered for approximately four hours at approximately 1000 degrees Celsius.

After sintering the nickel and titanium powders, a mechanical compaction procedure is performed on the sintered NiTi mixture to produce a nano-grained NiTi alloy (block 306). The approximate grain size for the initial blended NiTi is 45 μm. After compacting the blended NiTi for ten hours or longer and sintering, the grain size decreases to approximately 20 nm. The compaction procedure preserves the nanostructure of the NiTi particles generated by the sintering process discussed above. Regarding the compaction procedure, the whole technique of Spark Plasma Sintering is generally "non-conventional" due to its uniqueness in terms of obtaining dense samples in a very short period of time. In this technique one can obtain very dense samples without going through the conventional methods of pressing and furnace sintering that are well known.

In a particular embodiment, the sintering process and the mechanical compaction procedure mentioned above are performed as separate steps, as shown in FIG. 3. In alternate embodiments, the sintering process and the mechanical compaction procedure can be performed simultaneously in the same processing device. In a particular embodiment, the endodontic alloy is formed using a die during the sintering and compaction processing. The focus is to produce a block of nanograined NiTi after mixing and sintering. The use of non-conventional techniques will help in avoiding undesirable grain growth and the retention of nanostructure after the block is produced then a typical processing of Ni—Ti wires will be done (described below). This approach of combining non-conventional technique of sintering plus the torsion and machining is novel. The file design is not part of the invention.

After preparing the nano-grained NiTi alloy, nano-grained NiTi alloy wires (block 308) are formed from the alloy. At block 310, any rotary endodontic instruments such as file(s) are produced using the NiTi alloy wires to improve the characteristics of the newly formed endodontic instruments. In one implementation, the formed endodontic instrument is heat-treated to stabilize the nano-grained NiTi alloy structure. Regarding the specific temperatures and time periods used for this heat treatment process: the wire undergoes a heat treatment (usually 450-550 C) to express the shape memory or superelastic properties and to achieve the desired combination of mechanical properties.

The use of nano-grained NiTi material discussed herein provides enhanced structural stability in the newly formed instrument(s). In particular, it is difficult for a dislocation activity to overcome the nano-grain boundaries because nucleation needs to occur in each nano-grain, which helps to maintain the integrity of the nano-structure. Additionally, the nano-grained NiTi approaches thermodynamic equilibrium by transforming into R-phase, and later into B19' martensite on a nanograin-by-nanograin basis. This transformation into B19' martensite further increases the fracture resistance of the endodontic instrument. The transformation from R-phase to B19' martensite is induced by the mechanical compaction procedure and strong undercooling associated with that procedure applied to sintered NiTi mixture (such as block 306 in FIG. 3). This procedure stabilizes the martensite and the pre-martensitic R-phase.

The stabilization of the nano-grained NiTi reduces or eliminates undesirable responses to temperature and/or mechanical forces experienced by conventional NiTi. Without such heat treatment (and resulting stabilization), the endodontic instrument may experience fracture or failure due to the one step phase transformation of B2 to B19' or the stress-induced phase transformation from austenite to martensite. The heat-treated instrument(s) produced by the procedure of FIG. 3 offers greater resistance to cyclic fatigue.

Example 1

Producing Nano-Grained NiTi Alloy into an Endodontic Instrument

After preparing the nano-grained NiTi alloy an endodontic instrument is formed using that nano-grained NiTi alloy (block 308). In a particular embodiment the endodontic alloy is formed using a die during the sintering and compaction processing (as described above). This is followed by a typical processing of Ni—Ti wires includes vacuum casting of an ingot followed by hot forging, rolling and drawing to reduce ingot diameter. This condition is followed by cold working at a low rate (10% area reduction for each pass) to an extent of 30-50% to achieve the final diameter. To achieve the second state the wire undergoes a heat treatment (usually 450-550 C) to express the shape memory or superelastic properties and to achieve the desired combination of mechanical properties. The heat treatment releases the strain hardening of the Ni—Ti alloys, restoring the mobility of twin boundaries, and thus increasing the elongation after fracture and the transformation temperatures.

CONCLUSION

Although the systems and methods for nano-endodontic instruments have been described in language specific to structural features and/or methodological operations or actions, it is understood that the implementations defined in the appended claims are not necessarily limited to the specific features or actions described. Rather, the specific features and operations for nano-endodontic instruments are disclosed as exemplary forms of implementing the claimed subject matter.

The invention claimed is:

1. A method for producing an endodontic instrument comprising:

producing NiTi (nickel-titanium) to form nano-grained wire(s), the producing including:

preparing a mixture of 54-57% wgt nickel (Ni) powder and 43-46% wgt titanium (Ti) powder and wherein the average particle size of the nickel particles and the titanium particles is approximately 30-40 μm (micrometers);

sintering said mixture for about four (4) hours at about 1000° C. and mechanically compacting for about ten (10) hours the mixture of nickel and titanium powders to produce a nano-grained NiTi alloy with a grain size of about 20 nms;

forming a nano-grained wire(s) with a length of about 20-35 mms and an amount of taper ranging from approximately 2% to 12% of the nano-grained NiTi alloy and wherein the diameter of the instrument body decreases toward the tip of the instrument; and heat treating the nano-grained wire at about 450°-550° C. to achieve a desired combination of mechanical properties.

2. The method of claim 1 wherein the nano-grained wire(s) is/are used to generate an endodontic instrument.

3. The method of claim 2 wherein the nano-grained wire(s) is used to generate an endodontic file having a shank, a working portion and a rounded tip.

* * * * *